US010804592B2

(12) United States Patent
Hirabayashi et al.

(10) Patent No.: US 10,804,592 B2
(45) Date of Patent: Oct. 13, 2020

(54) ANTENNA AND WINDOW GLASS

(71) Applicant: CENTRAL GLASS COMPANY, LIMITED, Ube-shi, Yamaguchi (JP)

(72) Inventors: Kanya Hirabayashi, Matsusaka (JP); Kazuhito Tonoe, Matsusaka (JP)

(73) Assignee: CENTRAL GLASS COMPANY, LIMITED, Yamaguchi (JP)

( * ) Notice: Subject to any disclaimer, the term of this patent is extended or adjusted under 35 U.S.C. 154(b) by 0 days.

(21) Appl. No.: 16/470,687

(22) PCT Filed: Feb. 27, 2018

(86) PCT No.: PCT/JP2018/007173

§ 371 (c)(1),
(2) Date: Jun. 18, 2019

(87) PCT Pub. No.: WO2018/180120

PCT Pub. Date: Oct. 4, 2018

(65) Prior Publication Data

US 2019/0326658 A1 Oct. 24, 2019

(30) Foreign Application Priority Data

Mar. 29, 2017 (JP) ..... 2017-066338

(51) Int. Cl.
*H01Q 1/22* (2006.01)
*H01Q 1/32* (2006.01)
*H01Q 13/10* (2006.01)

(52) U.S. Cl.
CPC ..... *H01Q 1/22* (2013.01); *H01Q 1/32* (2013.01); *H01Q 13/10* (2013.01)

(58) Field of Classification Search
CPC ..... H01Q 1/22; H01Q 1/32; H01Q 13/10
USPC ..... 343/713
See application file for complete search history.

(56) References Cited

U.S. PATENT DOCUMENTS 5,012,255 A * 4/1991 Becker ..... H01Q 1/1278 343/704
5,646,637 A * 7/1997 Miller ..... H01Q 1/1271 343/711

FOREIGN PATENT DOCUMENTS

JP 7-170119 A 7/1995
JP 2016-111505 A 6/2016
JP 2017-5711 A 1/2017

OTHER PUBLICATIONS

International Search Report dated May 22, 2018, issued in counterpart application No. PCT/JP2018/007173, w/English translation (3 pages).

* cited by examiner

*Primary Examiner* — Andrea Lindgren Baltzell
(74) *Attorney, Agent, or Firm* — Westerman, Hattori, Daniels & Adrian, LLP

(57) ABSTRACT

To provide high sensitivity to high frequency band signals, it is provided an antenna to be arranged on a window glass of a vehicle, the antenna comprising: a planar conductor to be arranged on the window glass; a slot formed as a rectangular region obtained by removing a conductor from the planar conductor; a power feeding unit arranged on a first side of the slot; and an element extending from a core-side terminal of the power feeding unit to a second side of the slot opposite to the first side, the slot being disposed at a position offset from a center of the planar conductor in a direction toward the first side.

8 Claims, 5 Drawing Sheets

ANTENNA AND WINDOW GLASS

BACKGROUND OF THE INVENTION

This invention relates to an antenna to be arranged on a surface of a glass plate, and more particularly, to an antenna having high sensitivity in a broad band.

Hitherto, as a glass antenna for a vehicle, there has been known an antenna for receiving radio broadcasting signals and television broadcasting signals. Further, in recent years, it has been required to provide antennas for vehicle-to-vehicle communication and road-to-vehicle communication in vehicles.

Meanwhile, as the shortage of frequency resources progresses, higher frequencies are used for wireless communication. For high frequencies in a band of, for example, from 4 GHz to 6 GHz, small-size antennas are used, but such antennas are susceptible to the influence of objects around the antennas. Accordingly, it is difficult to ensure broadband and high-sensitivity characteristics for high-frequency antennas.

As vehicle antennas for vehicle-to-vehicle communication, in each of JP 2016-111505 A and JP 2017-5711 A, there is described a vehicle glass antenna, which is formed of linear elements and can provide high receiving sensitivity to vertically polarized waves from the front side and rear side of the antenna.

However, in a glass antenna formed of a linear element, as transmission/reception frequencies become higher, glass exerts greater influence on signals. For example, in a dipole antenna formed on the surface of a glass plate, when the thickness of glass on which an antenna pattern is to be provided is about 1/10 of an effective wavelength considering a wavelength shortening rate of the glass, a gain is about 8 decibel lower than that in the case where glass is thinner.

Accordingly, it is required to provide an antenna having high sensitivity to high frequency band signals.

It is an object of this invention to provide an antenna having high sensitivity in a high frequency band.

SUMMARY OF THE INVENTION

That is, according to at least one embodiment of this invention, there is provided an antenna to be arranged on a window glass of a vehicle, the antenna comprising: a planar conductor to be arranged on the window glass; a slot formed as a rectangular region obtained by removing a conductor from the planar conductor; a power feeding unit arranged on a first side of the slot; and an element extending from a core-side terminal of the power feeding unit to a second side of the slot opposite to the first side, the slot being disposed at a position offset from a center of the planar conductor in a direction toward the first side.

Further, the antenna according to the one embodiment of this invention further comprising an adjustment part having a protruding shape to enlarge the slot, the adjustment part being a part of the planar conductor recessed along the first side.

Further, in the glass antenna according to the one embodiment of this invention, the power feeding unit includes a coaxial connector connected to a power feeding wire, and a conductive seat, on which the coaxial connector is to be disposed, the conductive seat is disposed so as to connect two lateral sides of the adjustment part intersecting the first side, a core-side terminal of the coaxial connector is connected to the element, and an earth-side terminal of the coaxial connector is connected to the conductive seat.

Further, in the glass antenna according to the one embodiment of this invention, the planar conductor is provided in proximity to a body flange such that a side of the planar conductor close to the slot is capacitively coupled to the body flange.

Further, in the glass antenna according to the one embodiment of this invention, the planar conductor has formed therein an auxiliary slot, which is formed as a rectangular region configured by removing a conductor, and is disposed to be parallel to the second side of the slot.

Further, in the glass antenna according to the one embodiment of this invention, the auxiliary slot includes a width smaller than a width of the slot.

Further, in the glass antenna according to the one embodiment of this invention, the auxiliary slot includes a plurality of auxiliary slots, and the plurality of auxiliary slots are formed as regions having progressively larger sizes as the plurality of auxiliary slots approach the slot.

Further, a window glass according to the one embodiment of this invention comprising any one of the antennas being arranged on the window glass.

According to one embodiment of this invention, it is possible to reduce the influence of glass in a high frequency band to allow high sensitivity to be obtained in a broad band. As a result, it is possible to receive, with high sensitivity, radio waves in any frequency band in a 4 to 6 GHz band, which are investigated as radio waves for 5G communication, or radio waves in a 5.9 GHz band, which are investigated as radio waves for vehicle-to-vehicle communication.

BRIEF DESCRIPTION OF THE DRAWINGS

The present invention can be appreciated by the description which follows in conjunction with the following figures, wherein.

DETAILED DESCRIPTION OF THE PREFERRED EMBODIMENT

Figure 1:
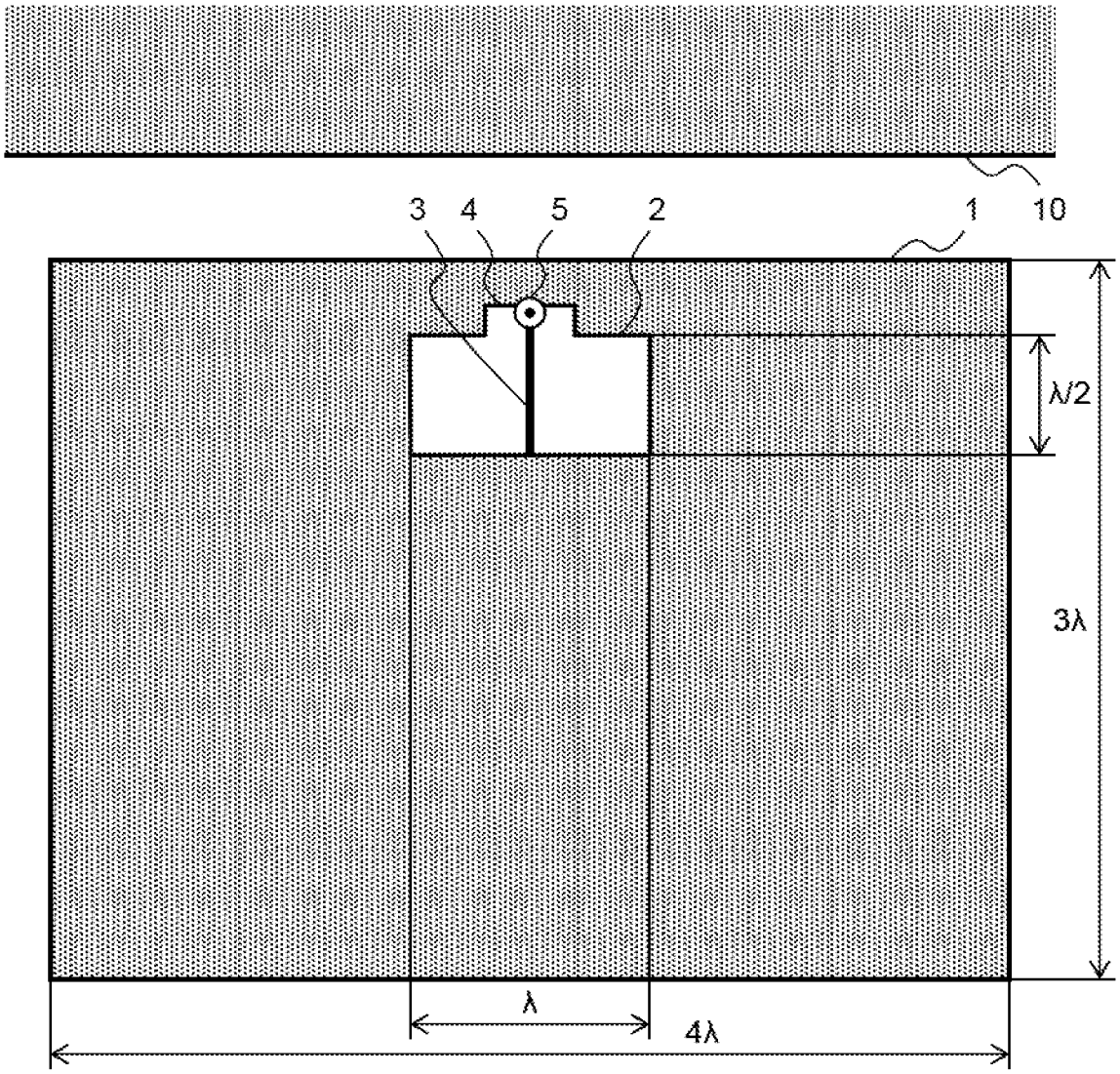
FIG. 1 is a plan view of a glass antenna according to an embodiment of this invention as viewed from a vehicle interior side.

FIG. 1 is a plan view of a glass antenna according to an embodiment of this invention as viewed from a vehicle interior side.

As illustrated in FIG. 1, the glass antenna of the embodiment of this invention is formed of a planar conductor 1 having a slot 2 formed therein.

The planar conductor 1 is disposed on glass so as to have one side in proximity and parallel to the bond flange 10 to be capacitively coupled to a body flange 10. It is preferred to adjust a size of the planar conductor 1 in consideration of wavelength shortening by glass such that, where $\lambda$ refers to a wavelength of a center frequency in the frequency band, a lateral dimension thereof may be $4\lambda$, while a vertical dimension thereof may be $3\lambda$. Where $\alpha$ refers to a wavelength shortening rate of glass ($\alpha$=0.7), it is preferred to adjust the size of the planar conductor 1 such that the lateral dimension thereof corresponds to $4\alpha\lambda$, while the vertical dimension thereof corresponds to $3\alpha\lambda$. When the size of the planar conductor 1 is large, the characteristics of the antenna are favorably stabilized.

In the planar conductor 1, the slot 2 being a region in which there is no conductor is formed. Specifically, the slot 2 is formed of a hole formed in the planar conductor 1 by partially removing the planar conductor 1.

The slot 2 is disposed at a position offset from the center of the planar conductor 1 in a direction toward a side of the planar conductor 1 close to the body flange 10. It is appropriate to adjust a size and position of the slot 2 depending on a structure in which the antenna is to be disposed, for example, a vehicle body. Through the disposition of the slot 2 at a position offset from the center of the planar conductor 1 toward the body flange 10, a connector 5 can be provided on a colored region provided in the peripheral portion of the glass to allow the connector 5 to be indistinctive to a driver. In addition, an electric field is directed to a place on an extension line of the element 3 in which the area of the planar conductor 1 is larger, and hence directivity of the antenna is in a direction inclined from a direction perpendicular to the planar conductor 1. As a result, when the antenna is disposed on the front glass of an automobile, the directivity of the antenna is likely to be oriented in a horizontal direction.

It is also appropriate to provide the slot 2 in the center of the planar conductor 1 in a left-right direction thereof. The slot 2 may also be disposed at a position rightwardly or leftwardly offset from the center. Through the disposition of the slot 2 at a position rightwardly or leftwardly offset from the center of the planar conductor 1 in the left-right direction, the directivity of the antenna is oriented in a direction in which the area of the planar conductor 1 is larger when viewed from the slot 2. This allows the directivity of the antenna to be adjusted in the left-right direction through use of the position of the slot 2.

It is preferred to adjust the size of the slot 2 in consideration of wavelength shortening by glass such that, where $\lambda$ refers to the wavelength of a center frequency in the frequency band, the lateral dimension thereof may be $\lambda$, while the vertical dimension thereof may be $\lambda/2$. Where $\alpha$ refers to the wavelength shortening rate of glass ($\alpha$=0.7), it is preferred to adjust the size of the slot 2 such that the lateral dimension thereof corresponds to $\alpha\lambda$, while the vertical dimension thereof corresponds to $\alpha\lambda/2$. The bandwidth varies depending on the size of the slot 2, and hence the bandwidth can be adjusted through use of the size of the slot 2.

To the planar conductor 1 at the position at which an upper side of the slot 2 is formed, the connector 5 is attached. To the connector 5, a power feeding wire (e.g., coaxial cable) to be connected to a wireless device is connected. A power feeding position at which the connector 5 is to be attached to the planar conductor 1 is allowed to be displaced from the center in the lateral direction of the slot 2 by about 20 percent of the width thereof. By leftwardly or rightwardly changing of the position (i.e., power feeding position) at which the connector 5 is to be attached to the planar conductor 1, the directivity of the antenna can leftwardly or rightwardly be adjusted. In addition, the leftward or rightward change of the position at which the connector 5 is to be attached to the planar conductor 1 allows impedance of the antenna to be adjusted.

In short, in the antenna of this embodiment, the directivity of the antenna can be adjusted through use of the position of the slot 2 and the power feeding position (position of the connector 5) in the slot 2.

It is appropriate to provide the slot 2 with a protruding adjustment part 4 (recess in the planar conductor 1) for the attachment of the connector 5. Depending on a size of the adjustment part 4, the impedance of the antenna varies, and hence the impedance of the antenna can be adjusted through use of the size of the adjustment part 4.

A core-side terminal of the connector 5 is connected to the element 3. The element 3 is connected to the planar conductor 1 forming an opposite side of the slot 2 to feed power to the opposite side of the slot 2. A ground-side terminal of the connector 5 is connected to the planar conductor 1.

The planar conductor 1 and the element 3 are formed by applying a conductive ceramic paste into the shape of the glass surface, drying the ceramic paste, and then baking the ceramic paste by a heating oven. The planar conductor 1 and the element 3 may also be formed of a metal plate.

Figure 2:
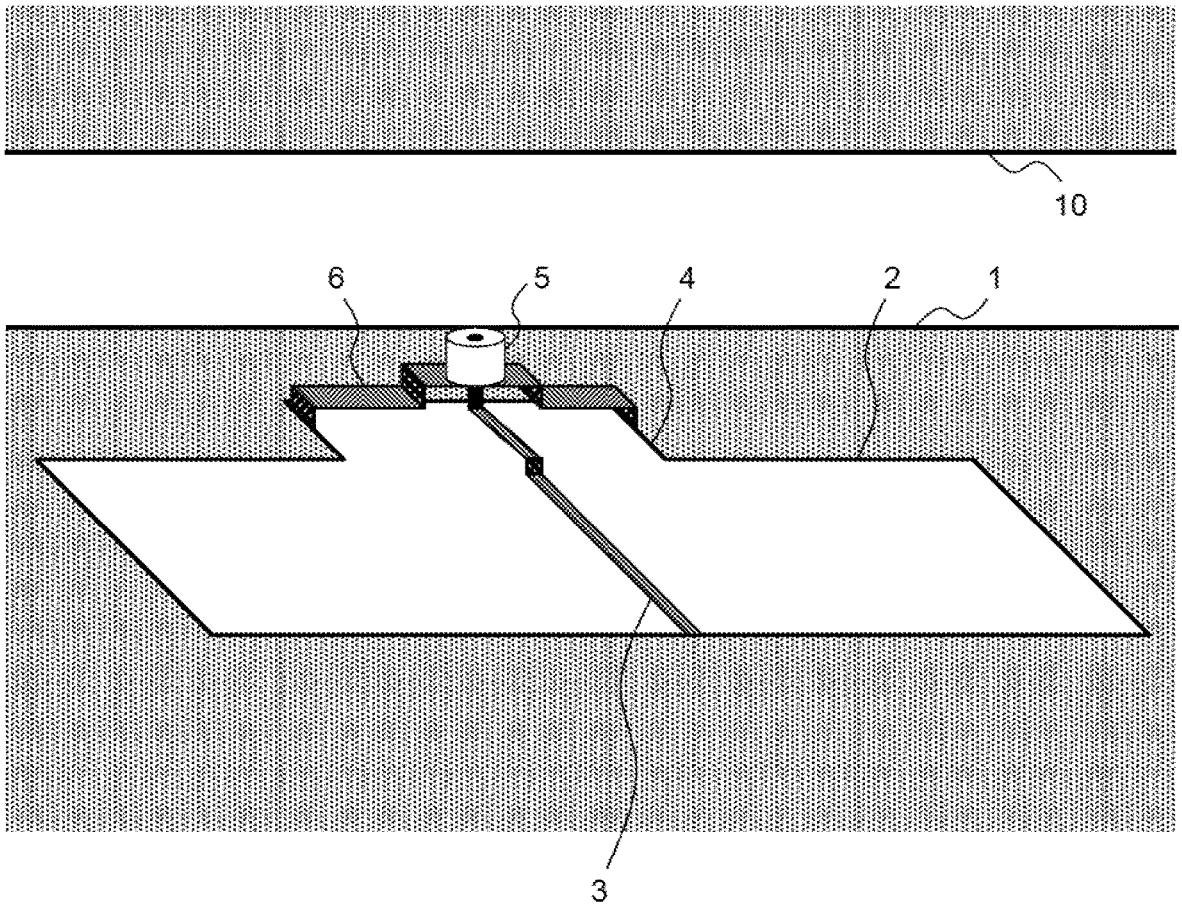
FIG. 2 is a perspective view for illustrating the glass antenna of this embodiment.
Figure 3:
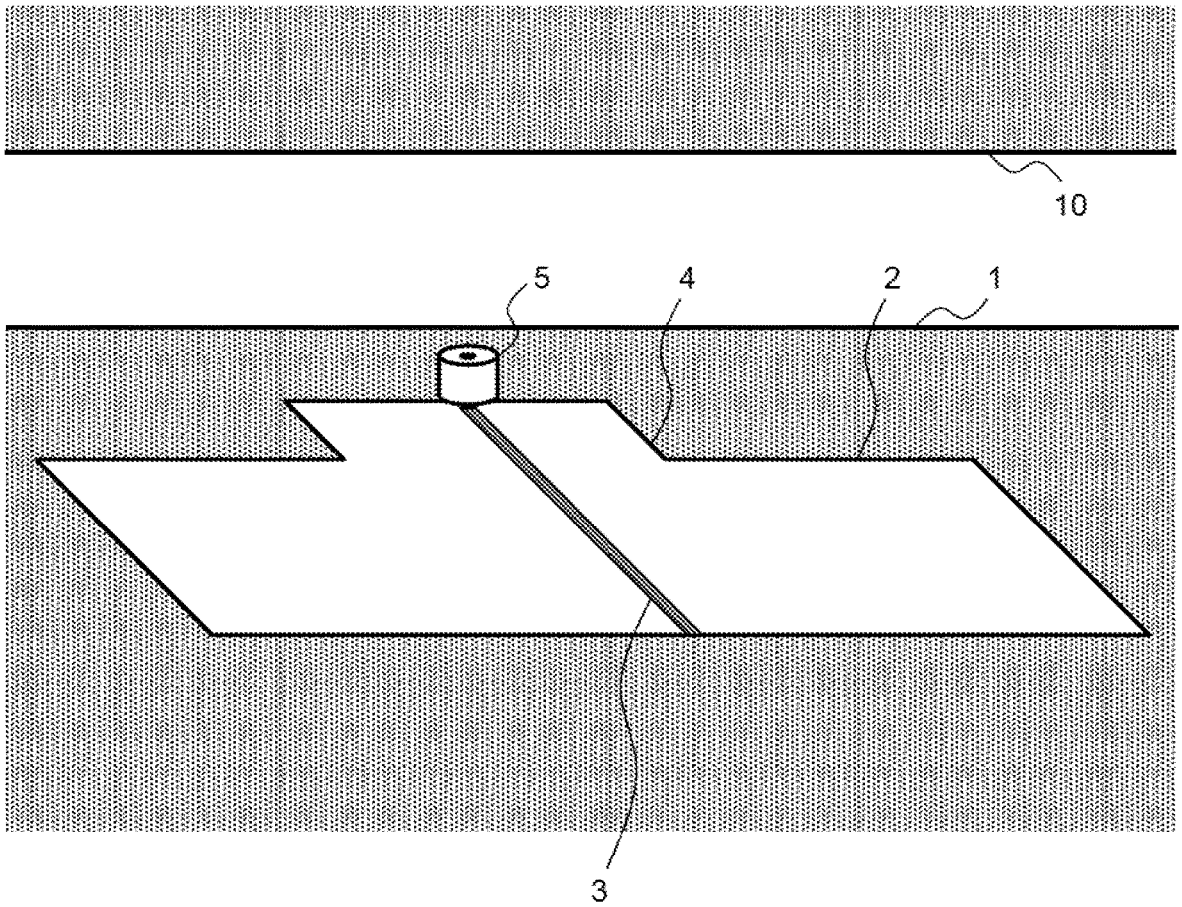
FIG. 3 is a perspective view for illustrating the glass antenna having another example of a power feeding unit of this embodiment.

FIG. 2 and FIG. 3 are perspective views for illustrating the glass antenna of this embodiment (viewed from the vehicle interior), in which a configuration of a power feeding unit is particularly illustrated.

In the power feeding unit illustrated in FIG. 2, the connector 5 is provided on a seat 6. The seat 6 is formed of a metal plate into a protruding shape, and has leg portions connected to the planar conductor 1 located in the vicinities of the left and right lateral sides of the adjustment part 4. In other words, the seat 6 is disposed so as to connect the two lateral sides orthogonal to the side on which the adjustment part 4 is provided. The middle portion of the seat 6 is formed to be higher by one step than the other portion thereof, and the connector 5 is attached to the middle portion.

The ground-side terminal of the connector 5 is connected to the seat 6, while the core-side terminal of the connector 5 is connected to the element 3. When the element 3 is formed of a metal plate, an end portion of the element 3 is connected to the core-side terminal of the connector 5. Alternatively, when the element 3 is formed by baking a conductive paste, it is appropriate to connect the element 3 and the connector 5 via a conductor, for example, a metal plate.

In a mode illustrated in FIG. 2, the connector 5 is attached to the seat 6. Consequently, irrespective of the position at which the connector 5 is attached to the seat 6, a size of the adjustment part 4 can be changed. Accordingly, when the size of the adjustment part 4 is small, the distance between the core-side terminal of the connector 5 and a planar plate is reduced, with the result that the impedance of the antenna can be reduced.

In the power feeding unit in another mode illustrated in FIG. 3, the seat 6 is not provided so that the connector 5 is disposed on the planar conductor 1. The ground-side terminal of the connector 5 is connected to the planar conductor 1, while the core-side terminal of the connector 5 is connected to the element 3.

Figure 4:
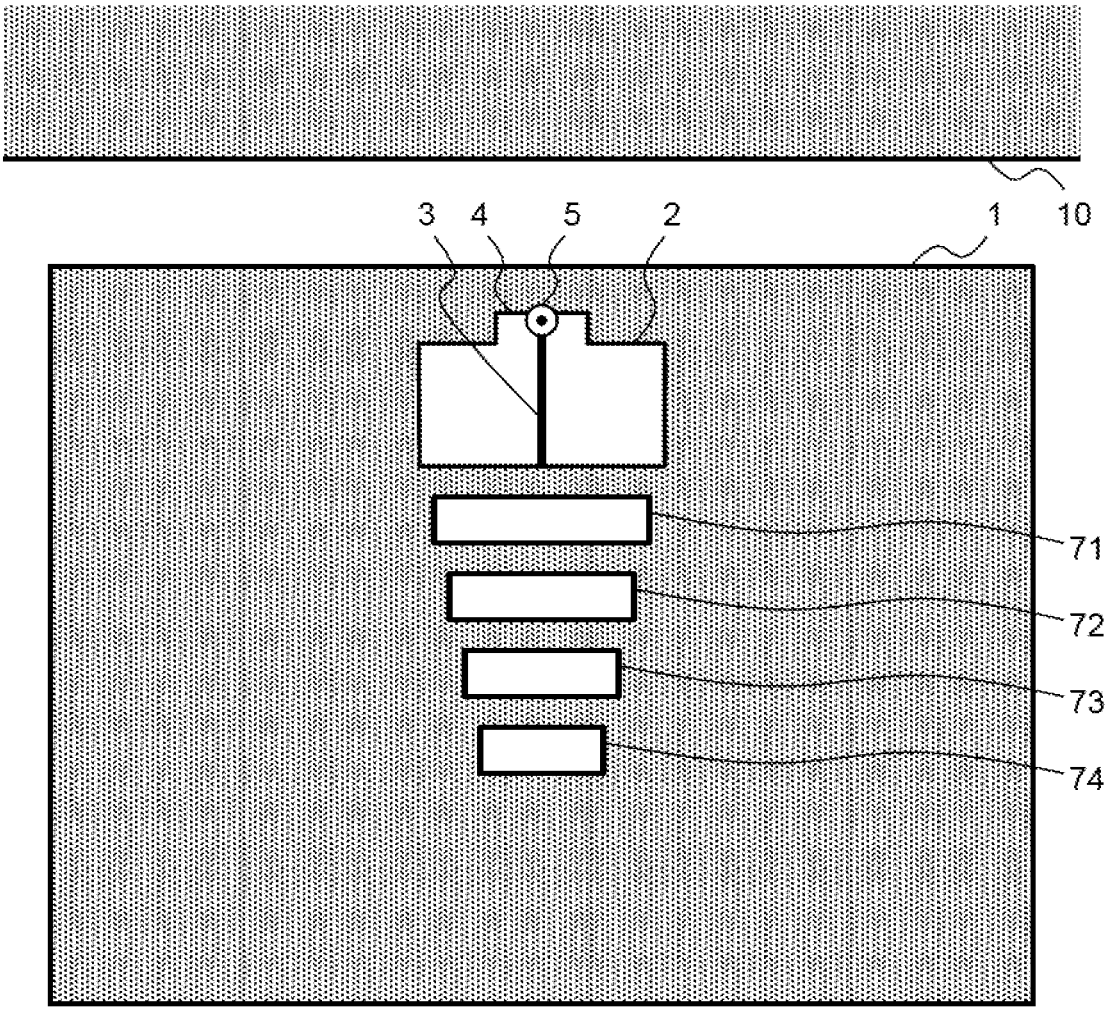
FIG. 4 is a view for illustrating a modification example of a pattern of the antenna of this embodiment.

FIG. 4 is a view for illustrating a modification example of a pattern of the antenna of this embodiment.

In this modification example, auxiliary slots 71 to 74 are provided in parallel to the slot 2. Each of the auxiliary slots 71 to 74 is formed of a hole formed in the planar conductor 1 by partially removing the planar conductor 1.

It may be possible to provide a plurality of auxiliary slots as illustrated in FIG. 4 or provide only one auxiliary slot. For example, in the mode illustrated in FIG. 4, the auxiliary slot 71 is provided in proximity to the slot 2, the auxiliary slot 72 is provided in proximity to the auxiliary slot 71, the auxiliary slot 73 is provided in proximity to the auxiliary slot 72, and the auxiliary slot 74 is provided in proximity to the auxiliary slot 73.

The respective sizes of the auxiliary slots may appropriately be set such that the respective widths thereof are set progressively smaller with distance from the slot 2. In other words, the auxiliary slots are formed as regions having progressively larger sizes as the auxiliary slots approach the slot 2. For example, as illustrated in FIG. 4, the auxiliary slot 71 has a width smaller than that of the slot 2, the auxiliary slot 72 has a width smaller than that of the auxiliary slot 71, the auxiliary slot 73 has a width smaller than that of the auxiliary slot 72, and the auxiliary slot 74 has a width smaller than that of the auxiliary slot 73. By thus configuring the auxiliary slots such that the auxiliary slots have progressively smaller sizes, the auxiliary slots function as a wave director so that the directivity of the antenna is oriented in a direction in which the auxiliary slots are provided. In a mode other than this mode, the antenna may also include a plurality of (e.g., one to five) auxiliary slots each having an outer peripheral length corresponding to A.

Figure 5:
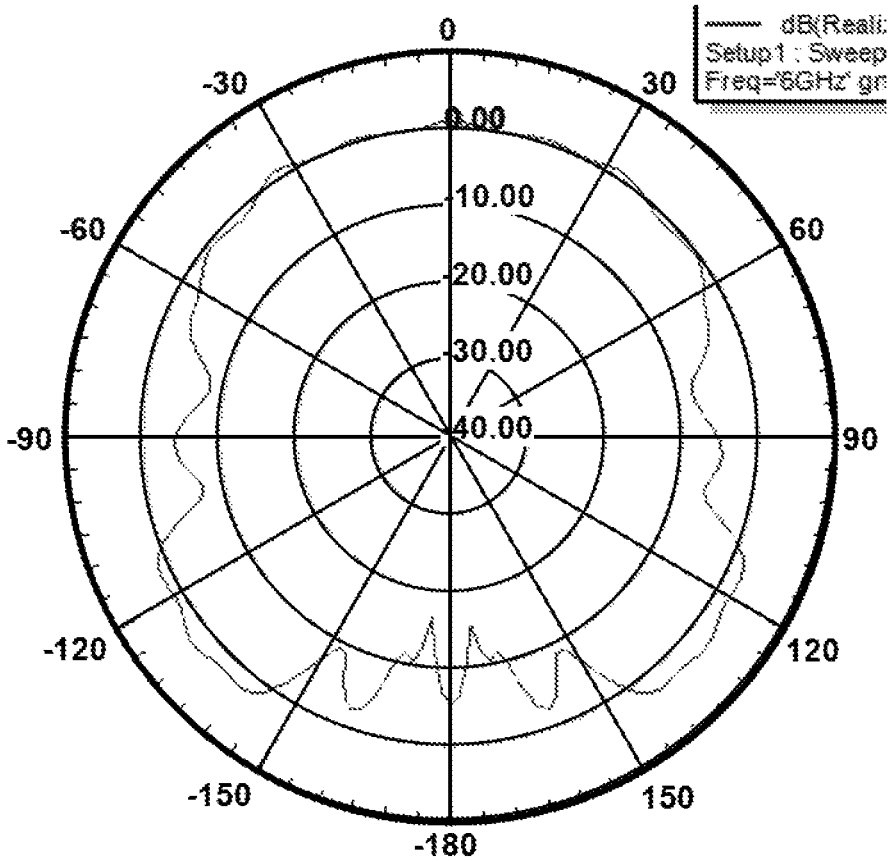
FIG. 5 is a diagram for illustrating the directivity of the antenna of this embodiment.

FIG. 5 is a diagram for illustrating the directivity of the antenna of this embodiment.

In FIG. 5, in the plane in which the planar conductor 1 is disposed, 180 degrees corresponds to the direction of the body flange 10. It can be seen that, as illustrated in FIG. 5, the antenna has directivity in the 0 degree direction (direction in which the area of the planar conductor 1 is larger when viewed from the slot 2) and, when the antenna is disposed on an upper portion of a front window glass of the vehicle, a large gain is obtained ahead of the vehicle.

While the present invention has been described in detail and pictorially in the accompanying drawings, the present invention is not limited to such detail but covers various obvious modifications and equivalent arrangements, which fall within the purview of the appended claims.

The present application claims priority from Japanese patent application JP2017-66338 filed on Mar. 29, 2017, the content of which is hereby incorporated by reference into this application.

What is claimed is:

1. An antenna to be arranged on a window glass of a vehicle, the antenna comprising:

a planar conductor to be arranged on the window glass;

a slot formed as a rectangular region obtained by removing a conductor from the planar conductor;

a power feeding unit arranged on a first side of the slot; and an element extending from a core-side terminal of the power feeding unit to a second side of the slot opposite to the first side, the slot being disposed at a position offset from a center of the planar conductor in a direction toward the first side.

2. The antenna according to claim 1, further comprising an adjustment part having a protruding shape to enlarge the slot, the adjustment part being a part of the planar conductor recessed along the first side.

3. The antenna according to claim 2, wherein the power feeding unit comprises a coaxial connector connected to a power feeding wire, and a conductive seat, on which the coaxial connector is to be disposed, wherein the conductive seat is disposed so as to connect two lateral sides of the adjustment part intersecting the first side, wherein a core-side terminal of the coaxial connector is connected to the element, and wherein an earth-side terminal of the coaxial connector is connected to the conductive seat.

4. The antenna according to claim 1, wherein the planar conductor is provided in proximity to a body flange such that a side of the planar conductor close to the slot is capacitively coupled to the body flange.

5. The antenna according to claim 1, wherein the planar conductor has formed therein an auxiliary slot, which is formed as a rectangular region configured by removing a conductor, and is disposed to be parallel to the second side of the slot.

6. The antenna according to claim 5, wherein the auxiliary slot includes a width smaller than a width of the slot.

7. The antenna according to claim 5, wherein the auxiliary slot includes a plurality of auxiliary slots, and wherein the plurality of auxiliary slots are formed as regions having progressively larger sizes as the plurality of auxiliary slots approach the slot.

8. A window glass, comprising the antenna of claim 1 being arranged on the window glass.

* * * * *